US006863436B2

(12) United States Patent
Kaelin

(10) Patent No.: US 6,863,436 B2
(45) Date of Patent: Mar. 8, 2005

(54) WATCH INCLUDING A CASING RING FOR A MOVEMENT MOUNTED IN A CASE ASSEMBLED VIA THE BEZEL OR VIA THE BACK COVER

(75) Inventor: Laurent Kaelin, Sonvilier (CH)

(73) Assignee: ETA SA Fabriques D'Ebauches, Grenchen (CH)

( * ) Notice: Subject to any disclaimer, the term of this patent is extended or adjusted under 35 U.S.C. 154(b) by 56 days.

(21) Appl. No.: 10/314,997

(22) Filed: Dec. 10, 2002

(65) Prior Publication Data

US 2003/0112713 A1 Jun. 19, 2003

(30) Foreign Application Priority Data

Dec. 19, 2001 (CH) ..... 2319/01

(51) Int. Cl.[7] ..... G04B 37/00
(52) U.S. Cl. ..... 368/298; 368/297; 368/309
(58) Field of Search ..... 368/276, 294–300, 368/309

(56) References Cited

U.S. PATENT DOCUMENTS 3,686,882 A * 8/1972 Fujimori ..... 368/281
4,120,149 A * 10/1978 Ripley ..... 368/294
4,548,514 A * 10/1985 Ganter ..... 368/291
5,831,939 A * 11/1998 Kaelin ..... 368/276
6,123,635 A * 9/2000 Farmos ..... 474/152
6,357,908 B1 * 3/2002 Hunziker ..... 368/287
6,757,619 B2 * 6/2004 Zison et al. ..... 368/299

FOREIGN PATENT DOCUMENTS

| | | |
|---|---|---|
| CH | 379 407 | 3/1964 |
| FR | 1 040 844 | 10/1953 |
| GB | 1 415 417 | 11/1975 |

* cited by examiner

*Primary Examiner*—Kamand Cuneo
*Assistant Examiner*—Jeanne-Marguerite Goodwin
(74) *Attorney, Agent, or Firm*—Sughrue Mion, PLLC

(57) ABSTRACT

The watch according to the invention includes a movement (2) on which a dial (4) is assembled and which is mounted in a casing ring (12) itself mounted in a case (14) including a crystal (16) secured to a bezel (20), a middle part (24) and a back cover (22). According to the invention, the case (4) includes an inner tubular part (38) at least partially surrounding the casing ring (12) and itself surrounded by the middle part (24) and snap fitting assembling means (64, 76) for connecting the back cover (22) and the bezel (20) via the inner tubular part (38). Moreover, this tubular part is designed to allow the casing ring (12) and the middle part (24) to be angularly positioned with respect to each other. In order to do this, it can have an axial slot (98) open towards the back cover (22), which an external projecting portion (94) of the casing ring and an internal projecting portion (96) of the middle part penetrate.

9 Claims, 2 Drawing Sheets

WATCH INCLUDING A CASING RING FOR A MOVEMENT MOUNTED IN A CASE ASSEMBLED VIA THE BEZEL OR VIA THE BACK COVER

BACKGROUND OF THE INVENTION

The present invention concerns a watch including a movement on which a dial is mounted, and assembled in a casing ring itself mounted in a case including a crystal secured to a bezel, a middle part and a back cover.

In this type of watch, it is often necessary to center and angularly position the crystal and/or the bezel with respect to the dial.

This is the case for example when the crystal or the bezel bear symbols or figures which co-operate with the hands to indicate the time or when the names of towns located in different time zones are marked on the bezel or even when transfers which may be various signs or a trademark are affixed under the crystal.

This is also the case when the watch has a date ring or disc whose figures appear in turn behind an aperture arranged in the dial and when the crystal has a lens for enlarging the figures.

Moreover, if only to allow a time-setting stem of the movement to pass through the middle part and the casing ring, it is also necessary in such watches for the two elements to be properly positioned both angularly and axially in relation to each other.

Very often, the positioning and assembling of the casing ring containing the movement and the various parts of the case are achieved via the middle part, i.e. taking the latter as the reference element, which requires it to have a more or less complicated shape and to be manufactured with precision. Its cost price is thus relatively high.

Moreover, it is quite common for the bezel, middle part and the back cover of the case to be assembled via screws. It is known, for example, to provide in the middle part, on the one hand a first series of holes for screwing on the bezel and on the other hand, a second series of holes for screwing on the back cover. In such conditions, it is not only the cost price of the middle part that is high, but also that of the entire case.

SUMMARY OF THE INVENTION

The object of the invention is to provide a watch whose case parts can be manufactured and assembled to each other and to the casing ring of the movement in a much simpler and more economical manner than in the case of the known watches that have just been mentioned.

This object, in addition to others, is achieved owing to the fact that in the watch according to the invention the case also includes a tubular inner part which at least partially surrounds the casing ring and which is itself surrounded by the middle part and snap-fitting assembling means to connect the back cover and the bezel via the inner tubular part and because this tubular part is designed to allow the casing ring and middle part to be angularly positioned in relation to each other.

BRIEF DESCRIPTION OF THE DRAWINGS

Other features and advantages of the invention will appear upon reading the following detailed but non-limiting description and which refers to the annexed drawings, in which.

DETAILED DESCRIPTION OF THE INVENTION

Figure 1:
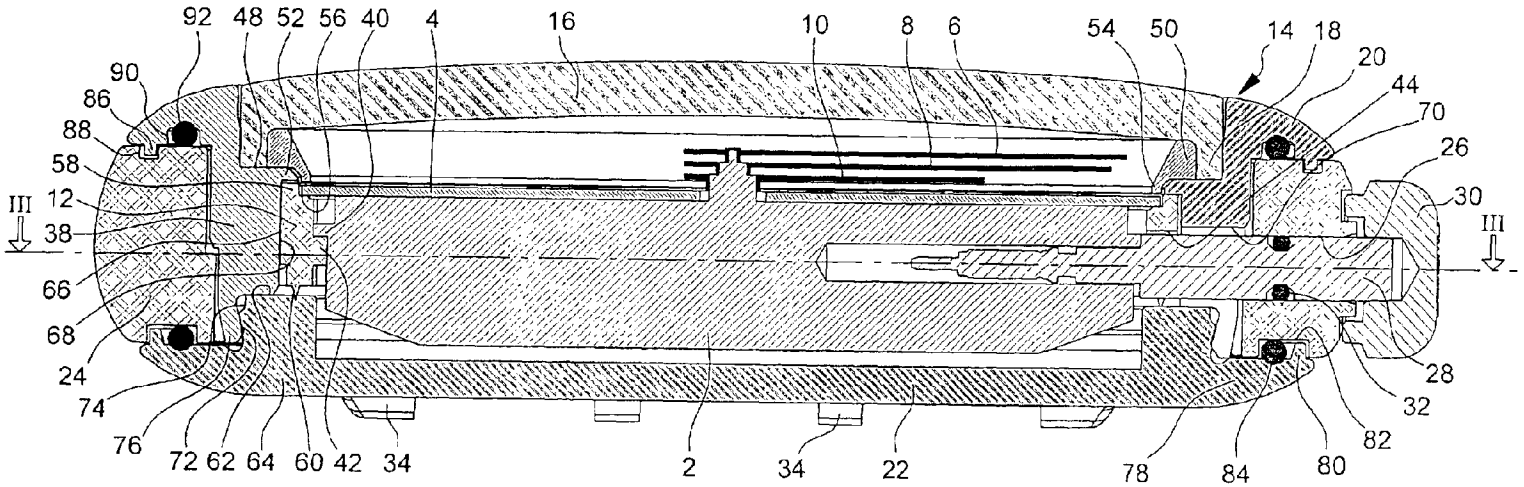
FIG. 1 is a general cross-section, at 3 o'clock, of a first embodiment of the watch according to the invention.
Figure 2:
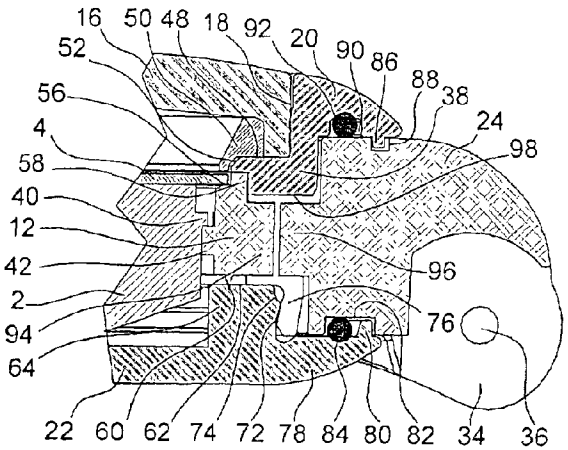
FIG. 2 is a partial cross-section, at 12 o'clock, of this first embodiment.
Figure 3:
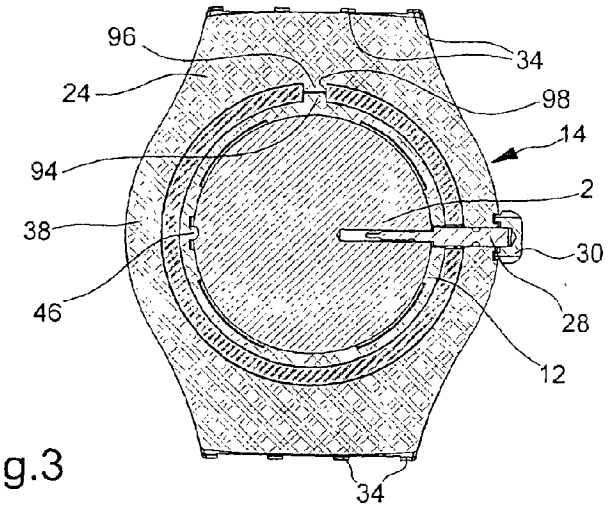
FIG. 3 is a smaller scale cross-section, along the line III—III of FIG. 1.

As shown in FIGS. 1 to 3, the watch according to the invention includes a movement 2 onto which is fixed a dial 4 and which drives second 6, minute 8 and hour 10 hands which move above the dial.

Movement 2 and dial 4 are mounted inside a casing ring 12 which, for a reason that will appear hereinafter, is made of a material that is plastically malleable when hot, and which is itself mounted in a case 14.

This case 14 includes a crystal 16 having a cylindrical edge 18, a metal bezel 20 surrounding the crystal, a back cover also made of metal 22 and a middle part 24 which can also be made of metal but which is preferably made of plastic material and through which a hole 26 passes at 3 o'clock for the passage of a time-setting stem 28 provided with a crown 30 and also forming part of the watch movement 2. As FIG. 1 shows, an O-ring joint 32 placed between the stem and middle part 24 assures the sealing of stem 28 as regards case 14. Further, this middle part 24 includes means allowing a wristband (not shown) to be secured to case 14. As they are shown in the Figures, these means are formed by two groups of fins 34 which have aligned holes 36 for the passage of a stem that is not shown. However, it is clear that these means could be different and be formed, for example, by pairs of conventional horns.

Finally, case 14 also includes an inner tubular part 38, connecting bezel 20 to back cover 22, which surrounds casing ring 12 and is itself surrounded by middle part 24 and which, in this first embodiment of the watch according to the invention, is made in a single piece with bezel 20.

This being said, the manner in which the various parts of the watch mentioned hereinbefore are positioned in relation to each other will now be described when necessary as well as the manner in which these parts are assembled.

First of all, as FIGS. 1 and 2 show, movement 2 has at its periphery a flange 40 which abuts against an inner projecting portion 42 of casing ring 12 that surrounds the movement with practically no play, except at the location where the ring has a through axial recess, more precisely a slot 44 open in the direction of back cover 22 of the case for the passage of time-setting stem 28, which ensures both the axial positioning and the radial positioning of the movement 2 inside the casing ring. As regards the angular positioning of the movement, this may be achieved like the watch of FIG. 3, i.e. owing to a guide stud 46 for the casing ring which is located exactly in the extension of the axis of the time-setting stem and which penetrates a corresponding recess or hole in the movement.

Returning to FIGS. 1 and 2, it can be seen that the cylindrical edge 18 of crystal 16 abuts against a shoulder 48 of tubular part 38 and that this edge 18 is squeezed on the one hand, between bezel 20 and the top of tubular part 38 and on the other hand, an inner ring 50, placed between the crystal and shoulder 48, in order to both secure the crystal and make the case water resistant at this point without having to use a sealing gasket.

Further, inner ring 50 extends beyond an annular projecting portion 52 of tubular part 38 which forms a part of shoulder 48 and also has a cylindrical edge 54 which presses dial 4, whose diameter is slightly greater than that of movement 2, against a shoulder 56 of casing ring 12 to immobilise movement 2 in the ring when the assembly is mounted in the case. Moreover, upper part 58 of ring 12 which is then in contact with the bottom face of annular projecting portion 52 forms one of the axial positioning means for the ring inside tubular part 38, the other means being formed by a series of cone-shaped points 60, whose peaks are crushed against the top face 62 of an axial annular edge 64 of back cover 22 when the back cover is assembled with tubular part 38, hence the necessity for a casing ring made of plastically malleable material. The drawings do not show the peaks of points 60 being crushed, but this is clearly described in European Patent document EP-A-1 046 967 which also indicates the advantages of using such points as axial positioning means for a casing ring in a watchcase.

As regards the radial positioning of casing ring 12, this is simply ensured by a narrow contact between a cylindrical part 66 of the external wall of the ring and a corresponding cylindrical part 68 of the inner wall of inner tubular part 38. By comparing the left part and the right part of FIG. 1, one can see that in this Figure the heights of these cylindrical parts 66 and 68 are limited because of slot 44 of the casing ring and a corresponding slot 70 of the tubular part which are in alignment with each other and with hole 26 of middle part 24 for the passage of time-setting stem 28. As will be understood hereinafter, the heights of these cylindrical parts 66 and 68 are also reduced in another zone to make room for angular positioning means for the casing ring and the middle part which form part of the invention and which will be specified hereinafter.

In the embodiment of the watch according to the invention which is currently being described, annular edge 64 of back cover 32 forms a part of the snap fitting assembling means for back cover 23 and bezel 20, via tubular part 38. For this reason, it has a truncated lateral wall 72 whose diameter increases from its base and a chamfer 74 which joins this wall 72 to its top face 62. The other part of the assembling means in question is formed by an annular extension 76 of tubular part 38 directed obliquely towards the interior of the case and whose thickness is sufficiently small for it to be able to deform elastically when the back cover and tubular part 38 are assembled. More precisely, when edge 64 is brought into contact with the edge of annular extension 76 and pressure is exerted on the back cover, this extension 76 is pushed back outwards by chamfer 74 of edge 64 to then slide onto truncated lateral wall 72 and surround and grip this edge 64 entirely when its top face 62 abuts against tubular part 38, crushing points 60 of casing ring 12, as has already been indicated.

This being said, the assembling of back cover 22 and tubular part 38 allows not only the assembly formed by movement 2, dial 4 and casing ring 12 to be held in place, but also middle part 24 which has previously been positioned and placed around tubular part 38. In order to do this, back cover 22 extends beyond annular edge 64 via an annular part 78 with a much smaller peripheral edge than edge 64, which engages in an annular groove 82 of middle part 24 in which a first sealing gasket 84 is housed. Further, bezel 20 also has a peripheral edge 86 which penetrates an annular groove 88 of the middle part, this bezel 20 being itself provided with an annular groove 90 in which a second sealing gasket 92 is placed.

To return to the angular positioning means for casing ring 12 and middle part 24, it can be seen in FIGS. 1 and 2 that these means include an external projecting portion 94 of the ring and a corresponding inner projecting portion 96 of the middle part which face each other and which penetrate another slot 98 also open towards the bottom of tubular part 38. As they are shown in the Figures, projecting portions 94 and 96 which preferably have a parallelepiped shape, have the same height and are arranged exactly facing each other, but this is not obligatory. These projecting portions could have different heights and/or be slightly offset axially with respect to each other. The essential point is that they have the same width and that this width is equal to that of slot 98 of the tubular part in order to ensure angular positioning of the ring and middle part without any play. Conversely, these projecting portions could be not at 12 o'clock, as in the drawings, but at 6 o'clock or at another location, provided that this location is different and sufficiently far away from the 3 o'clock position where time-setting stem 28 is located.

From the preceding description it is clear that in the watch according to the invention, middle part 24 does not play any role in the positioning and assembling of the other parts of the case, nor in the assembling of movement 2 and casing ring 12 in the case. It can thus have a simple shape and be easy to manufacture.

Moreover, as FIGS. 1 to 3 in part show, if this middle part has to be positioned angularly with precision with respect to tubular part 38, it can however have a slight axial and radial play, provided that sealing gaskets 84 and 92 allow this. In such conditions, the middle part is mounted so as to float between bezel 20 and back cover 2. As a result, the middle part can, on the one hand, act as a shock absorber for the other parts of the watch and, on the other hand, be made with quite wide tolerances, for example by moulding a plastic material, which allows its colouring and more generally its external appearance to be easily modified, including the means for assembling to a wristband, a watch or suchlike.

Finally, since the parts of the case and those of the movement and casing ring in the case are not positioned and assembled using screws, pins and other means of this type, these operations are greatly facilitated and the cost price of the finished watch is considerably reduced.

Figure 4:
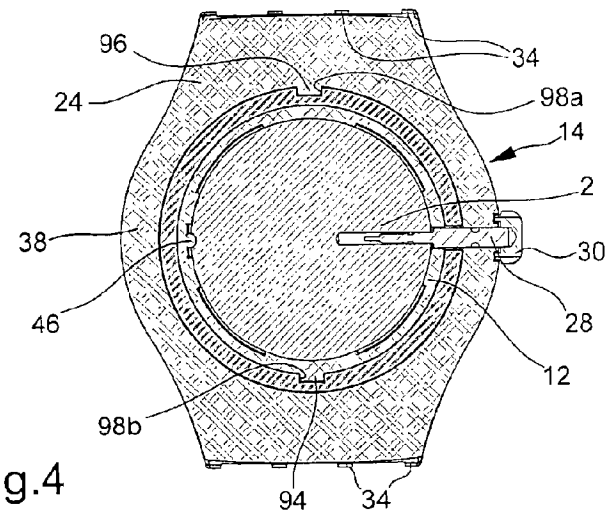
FIG. 4 is a similar cross-section to that of FIG. 3, showing a variant of the embodiment of the preceding Figures.

In the variant of FIG. 4, middle part 24 and casing ring 12 still have respective projecting portions 96 and 94 but these projecting portions no longer face each other and are no longer engaged in one single axial recess but in two axial recesses, which are respectively an external axial recess 98*a* and an inner axial recess 98*b* of inner tubular part 38 of case 14. As they are shown in the Figure, these projecting portions 96 and 94 and these grooves 98*a* and 98*b* are located at 12 o'clock and 6 o'clock but this is not obligatory. Moreover, everything that was previously stated with respect to the plays concerning middle part 24 remains true.

Figure 5:
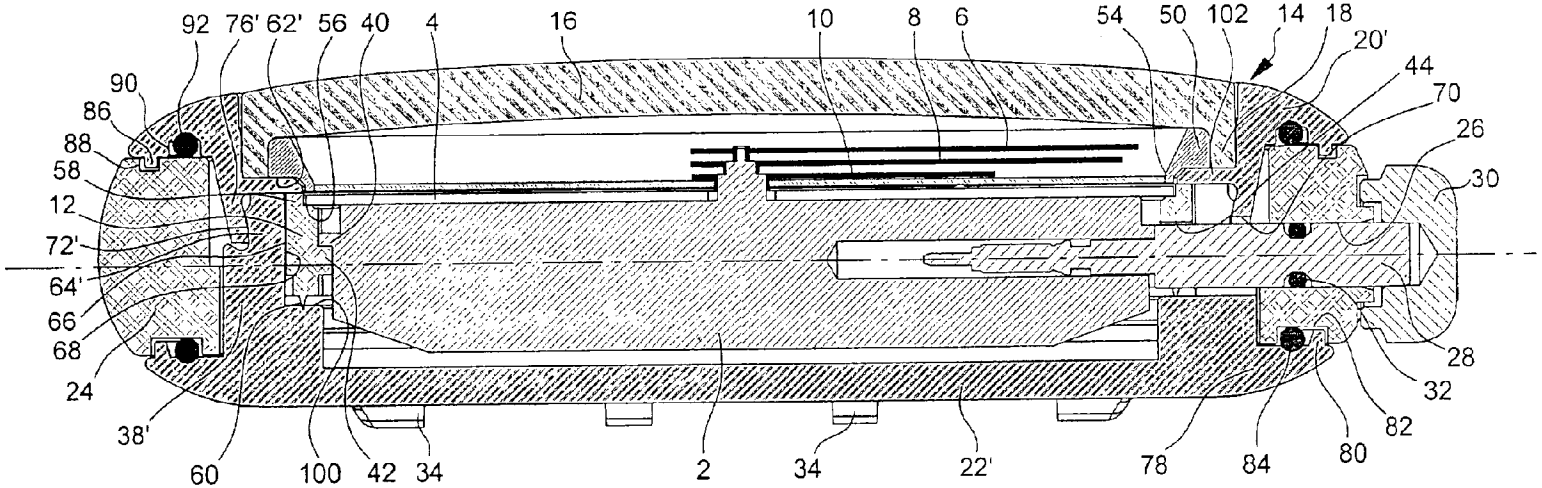
FIGS. 5 and 6 are similar cross-sections to those of FIGS. 1 and 2 showing a second embodiment of the watch according to the invention.
Figure 6:
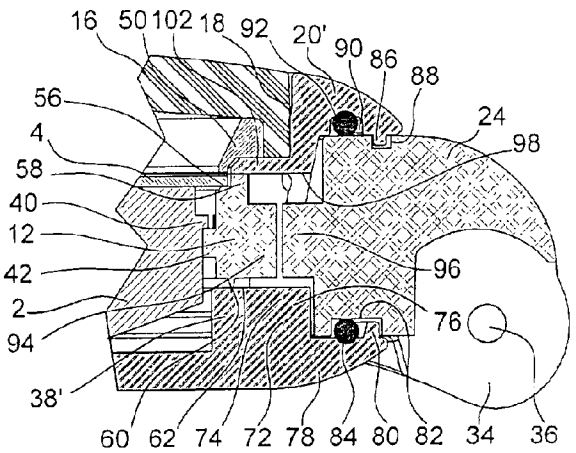

The differences between the embodiment of FIGS. 1 and 3 and that of FIGS. 5 and 6 of the watch according to the invention are due to the fact that, in the first, case 14 is assembled by the bezel and in the second by the back cover. Thus these differences concern practically only the bezel, the back cover and the tubular part of the case as well as the manner in which these elements are assembled. All the other parts of the watch are the same in both cases and are thus designated by the same reference numerals.

In order to indicate these differences between the second embodiment and the first, reference will be made to both FIGS. 5 and 6 and to FIGS. 1 and 2.

One of these differences is that inner tubular part 38' is no longer integral with bezel 20' but with back cover 22'. As FIG. 5 shows, this tubular part 38', which has a shoulder 100 on which points 60 of casing ring 12 abut, extends upwards via an edge 64' which has the same shape as edge 64 of the embodiment of FIGS. 1 and 2 and whose top face 62' is located at the same level as the top edge of the casing ring.

Moreover, this edge 64' co-operates in the same way as before with an annular extension 76' of bezel 20' to connect the bezel to back cover 22' via tubular part 38'.

Finally, a last difference between the two embodiments is that shoulder 48 and projecting portion 52 of the first embodiment are replaced in the second by an annular part 102 of bezel 20' which is gripped between on the one hand, cylindrical edge 18 of crystal 16 and inner ring 50 and, on the other hand, top face 62' of edge 64' and the top edge of casing ring 12.

This being said, it is clear that the invention is not limited to the two embodiments and the variant that have been described nor to the other variants that have been envisaged.

In particular, the casing ring and the middle part could have more than one projecting portion and the inner tubular part more than one slot or two grooves for angularly positioning the ring and the middle part, particularly in the case of a heavy movement where this would improve the resistance of the movement to angular shocks.

Moreover, the snap fitting assembling means of the bezel and the back cover via the tubular part could be different from those that have been described.

What is claimed is:

1. A watch including a movement on which a dial is assembled and which is mounted in a casing ring mounted in a case including a crystal secured to a bezel, a middle part and a back cover, wherein said case includes an inner tubular part, at least partially surrounding said casing ring and surrounded by said middle part, and snap fitting assembling means for connecting said back cover and said bezel via said inner tubular part, and wherein said inner tubular part allows said casing ring and said middle part to be angularly positioned in relation to each other.

2. The watch according to claim 1, wherein said inner tubular part is made in a single piece with said bezel.

3. The watch according to claim 2, wherein said snap fitting assembling means include an axial annular edge of the back cover having a truncated lateral wall whose diameter increases from said back cover and an elastically deformable annular extension of said inner tubular part directed obliquely towards the interior of the case, which co-operates with said truncated lateral wall to surround and grip said axial annular edge when said back cover and said bezel are assembled.

4. The watch according to claim 1, wherein said inner tubular part is made in a single piece with said back cover.

5. The watch according to claim 4, wherein said snap fitting assembling means include an axial annular edge extending said inner tubular part and having a truncated lateral wall whose diameter increases from said tubular part and an elastically deformable annular extension of said bezel directed obliquely towards the interior of the case, which co-operates with said truncated lateral wall to surround and grip said axial annular edge when said back cover and said bezel are assembled.

6. The watch according to claim 1, wherein said inner tubular part has an axial slot open towards the back cover, which an external projecting portion of said casing ring and an inner projecting portion of said middle part penetrate to angularly position said ring and said middle part with respect to each others.

7. The watch according to claim 1, wherein said inner tubular part has an external axial groove and an inner axial groove in which respectively an inner projecting portion of said middle part and an external projecting portion of said casing ring penetrate to angularly position said ring and said middle part with respect to each other.

8. The watch according to claim 1, wherein said middle part is mounted so as to float between the bezel and the back cover of the case by being clamped between two annular sealing gaskets housed in grooves respectively at said bezel and said back cover.

9. The watch according to claim 1, wherein said bezel, said back cover and said inner tubular wall are made of metal and in that said middle part is made of plastic material.

* * * * *